United States Patent [19]

Wardley et al.

[11] 4,206,356

[45] Jun. 3, 1980

[54] X-RAY GENERATING ARRANGEMENTS

[75] Inventors: John Wardley, Hounslow; Gordon P. Davis, Sunbury-on-Thames, both of England

[73] Assignee: E M I Limited, Hayes, England

[21] Appl. No.: 911,404

[22] Filed: Jun. 1, 1978

[30] Foreign Application Priority Data

Jun. 3, 1977 [GB] United Kingdom ..... 23612/77

[51] Int. Cl.[2] ..... H05G 1/30

[52] U.S. Cl. ..... 250/402; 250/403; 250/445 T

[58] Field of Search ..... 250/445 T, 403, 404, 250/405, 416 TV, 402, 401

[56] References Cited

U.S. PATENT DOCUMENTS

| | | | |
|---|---|---|---|
| 2,638,554 | 5/1953 | Bartow | 250/416 TV |
| 3,949,229 | 4/1976 | Albert | 250/416 TV |

*Primary Examiner*—Craig E. Church

*Attorney, Agent, or Firm*—Cooper, Dunham, Clark, Griffin & Moran

[57] ABSTRACT

An X-ray tube in which the electron beam can be deflected over the target is provided with means for causing the electron beam to scan in stepped, rather than continuous, manner along the target.

7 Claims, 3 Drawing Figures

X-RAY GENERATING ARRANGEMENTS

The present invention relates to X-ray generating arrangements, and it relates more particularly to X-ray generating tubes having an elongated anode relative to which the electron beam of the tube can be scanned, for example, by electromagnetic means.

In some circumstances, for example when such an X-ray generating tube is used as an X-ray source in a computerised tomographic apparatus, the tube may be rotated around a cross-sectional slice of the body of a patient to be examined, so as to irradiate the body from many different directions. Alternatively, the tube may be constructed on toroidal, or part toroidal, form and the anode may be elongated and curved around the body so that it encircles said slice to at least a substantial extent.

In either case, it is desirable to enable the scanning of the electron beam relative to the anode to be effected in a substantially step-wise manner rather than in continuous manner. It is an object of this invention to provide an X-ray generating arrangement which enables such scanning to be carried out in substantially step-wise manner.

According to the invention there is provided an X-ray generating arrangement including a source of an electron beam, a target/anode member disposed to intercept said beam and including material which emits X-radiation in response to impingement of said beam thereon, said member being elongated, in at least one dimension, beyond the area of impingement of said beam thereon, deflection means for scanning said beam across said member in said at least one dimension, said deflection means including an electromagnetic deflection arrangement and circuit means for generating an electrical scanning waveform for application to said electromagnetic deflection arrangement, and further circuit means for generating a supplementary electrical waveform for application to said electromagnetic deflection means, the arrangement being such that said supplementary waveform, in combination with said first-mentioned waveform, when applied to said deflection arrangement, cause said electron beam to sweep across said member, generally in said at least one dimension, and to dwell at or adjacent selected regions of said member.

In order that the invention may be clearly understood and readily carried into effect, one embodiment thereof will now be described, by way of example only, with reference to the accompanying drawings, of which:

Figure 1:
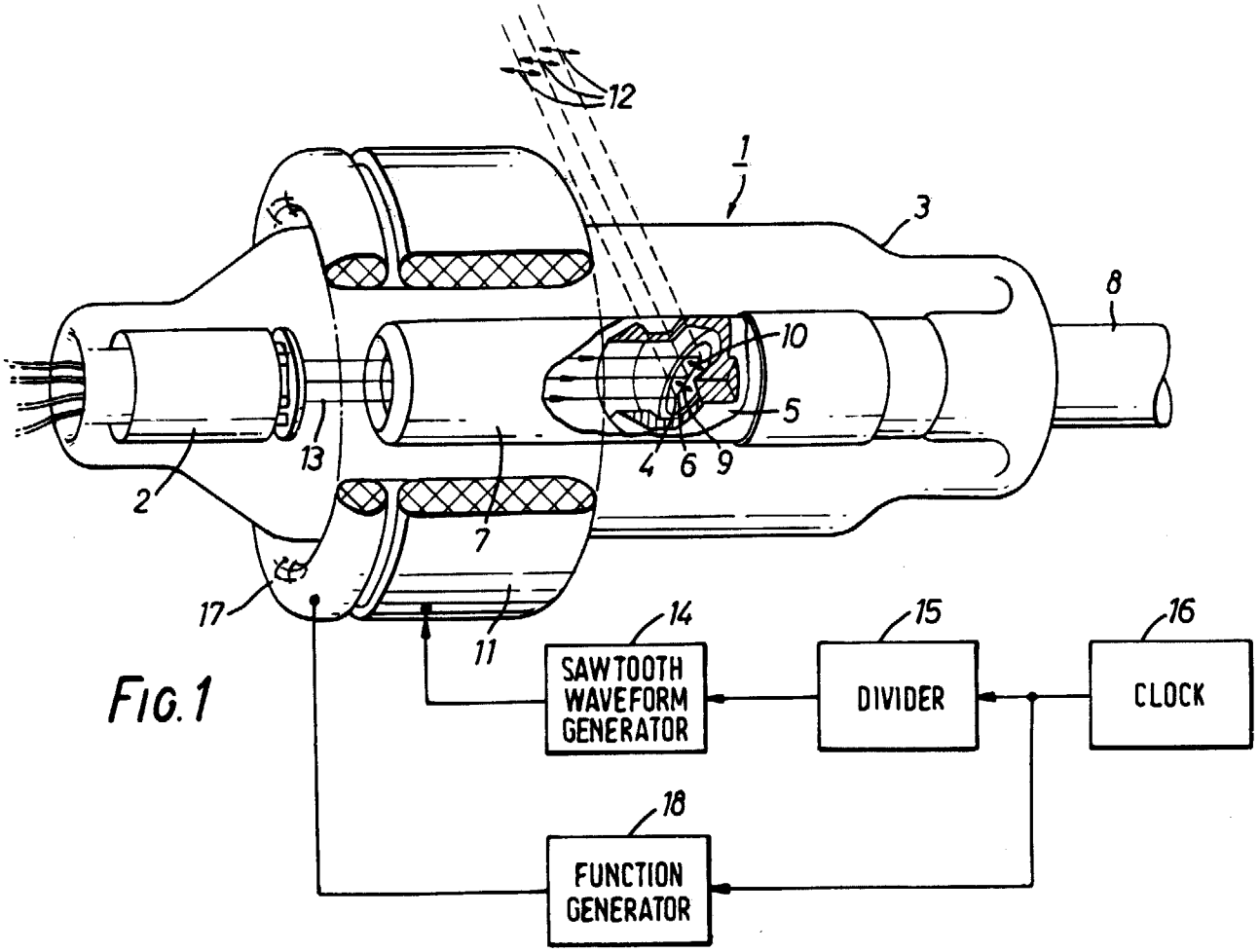
FIG. 1 shows, in generally schematic, outline form, an X-ray generating arrangement in accordance with one example of the invention.

Referring now to FIG. 1, an X-ray generating tube 1 includes an electron gun 2 which is arranged to project electrons in a ribbon-like beam 13 axially of the tube 1. The tube 1 is formed with a glass envelope 3 and contains a tungsten target 4 set in a copper anode 5. The tungsten target 4 emits X-rays in response to the impingement thereon of the electrons from the gun 2. The electrons are intended to impinge upon a line 6 about 1 mm wide on the target 4, and a drift tube 7, axially disposed in the tube 1 and projecting from the anode 5 towards the gun 2, is provided (in known manner) to produce the potentials which have to be applied to the tube components in order to establish a given strength of electric field in the tube. A cooling system of known kind, generally indicated at 8, is provided to cool the target anode member 4, 5. Forced oil cooling is a convenient technique.

In order that the electron beam 13 can be deflected across the target 4 in a direction substantially perpendicular to its length, as indicated by the arrows 9, 10, suitable scanning coils 11 are disposed around the tube 1 as shown. The deflection of the electron beam causes deflection of the X-radiation emitted from the target 4 as shown by the arrows 12. Typically, the electromagnetic deflection coils 11 are fed with electrical waveforms of sawtooth shape, derived in known manner from a sawtooth waveform generator circuit 14. The waveforms generated by the circuit 14 are triggered by timing pulses applied thereto from a clock pulse generating circuit 16 and by way of a divider circuit 15, which divides by n in frequency the pulses applied thereto from circuit 16. The divider circuit 15 can conveniently comprise an n stage binary counter which provides an output pulse and a reset pulse every time it has counted n of the clock pulses.

As thus far described, the electron beam 13 is swept linearly across the target 4 and flies back again at a frequency 1/n th of the frequency at which the clock pulses are generated.

In order to convert the linear sweep into a stepped sweep, during which the electron beam dwells at certain regions of the member 2 and moves rapidly between such regions, another coil 17 is provided around the envelope 3. The coil 17 is supplied with electrical waveforms applied thereto from a function generating circuit 18 which, in turn, receives and is synchronised by the clock pulses supplied by the clock pulse generating circuit 15. The function which is generated by the circuit 18 will be described in more detail later, but suffice to say at present that the effects of the deflection coils 11 and 17, and the waveforms applied thereto, upon the beam 13 cause the beam to effect the desired stepped sweep motion. In this example, because of the dividing factor n introduced by divider circuit 15, the beam will dwell in succession at n equally spaced regions along the target 4.

Suppose, for example, that the total distance over which the beam 12 is scanned along the target 4 is L cms. and that this scan is to be effected in T secs, during which time the beam is to dwell at n different regions. In these circumstances, the conventional sawtooth waveform applied to coils 11 is arranged to be such as to cause the beam 13 to sweep linearly across the target 4 with a velocity of L/T cm. per sec.

In accordance with this example of the invention, a scanning waveform of substantially smaller amplitude than that applied to coils 11, and of higher frequency, is generated in the function generator 18 and applied to the coils 17. The waveform so applied constitutes a sinusoidal waveform of amplitude and frequency given by the following formula:

$$0.32(L/n)\sin(2\pi T/n)t.$$

This waveform can be applied to additional coils, such as 17 as shown, or alternatively added to the sawtooth waveform for application to the main coils 11.

The circuit 18 can conveniently comprise an active or passive sinusoidal oscillator capable, in well known manner, of being synchronised by the application thereto of the pulses from circuit 16.

Figure 2:
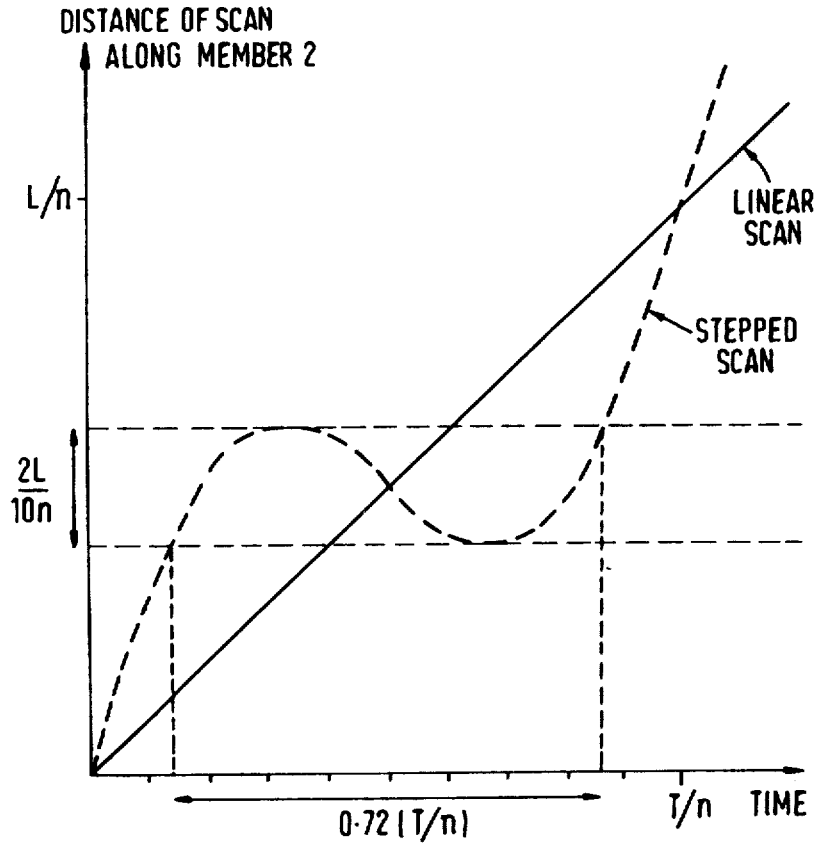
FIG. 2 shows in graphical form a scanning effect which can be achieved by means of an arrangement in accordance with an example of the invention.

In either event, the result of superimposing such a sinusoidal waveform on a linear scan is shown in FIG. 2 for a single time period T/n. It can be seen that the beam performs a small oscillation about a mid-point with a movement of $\pm L/10n$, and that the beam is then rapidly swept away to oscillate about the next mid-point. The time during which the beam is effectively stationary is thus 0.72 of the time period T/n. The additional scanning power required to achieve this stepped scanning, compared with that required for the linear scan, is small; the amplitude of the sinusoidal waveform being only 0.32/n times that of the linear scan amplitude.

Similarly, the stepped scanning can be improved by adding higher harmonics of the sinusoidal waveform in the appropriate amplitudes and phases, as is well known in the art of synthesising a waveform by a Fourier series.

It will be appreciated that, as the beam dwells at certain regions of the target 4, the heating effect at those regions can be considerable especially when the tube is operating at the kind of output radiation levels required for computerised tomography. Preferential cooling can thus be applied to these regions if desired.

It will also be appreciated that, by placing a switch in the connection between circuits 16 and 18, the arrangement can be made convertible, upon actuation of the switch, from linear scanning to stepped scanning and vice-versa.

When an arrangement, such as that shown in FIG. 1, is used in a computerised tomographic apparatus, the clocking signals need not be derived from a dedicated circuit such as 16, but they may instead be derived from the computer which controls the operation of the apparatus. The circuits 14 and 18 are analogue circuits which are merely triggered by the digital clocking pulses.

Figure 3:
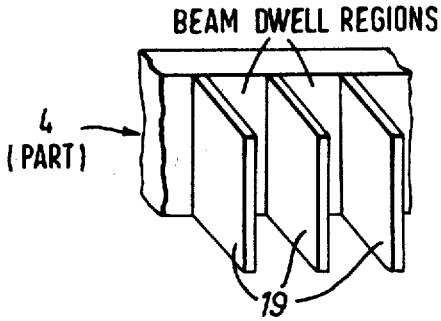
FIG. 3 shows a detailed embodiment of the target member of the invention.

In a development of the invention, as shown in part in FIG. 3, the target member 4 can contain upstanding partitions 19, facing the electron beam 13, which flank each of the dwell positions of the electron beam on the target member. These partitions assist in collimating the radiation to a desired fan angle.

What we claim is:

1. An x-ray generating arrangement including a source of an electron beam, a target/anode member disposed to intercept said beam and including material which emits X-radiation in response to impingement of said beam thereon, said member being elongated in one dimension, beyond the area of impingement of said beam thereon, deflection means for bidirectionally scanning said beam across said member in said dimension, the scanning in one direction being effected at a relatively slow rate and the scanning in the other direction being effected at a relatively fast rate, said beam being constrained to scan solely in said dimension the arrangement including circuit means for generating an electrical scanning waveform for application to said deflection means; and further circuit means for generating a supplementary electrical waveform for application to said deflection means to periodically arrest the progress of the electron beam, when scanned across said member in said one direction, to dwell at, or adjacent, each of a plurality of regions spaced apart in said dimension across said member and to move rapidly across said member in said one direction between neighboring regions, wherein the electron beam does not dwell at said regions in the scanning thereof at said relatively fast rate.

2. An arrangement according to claim 1 wherein said deflection means comprises separate electromagnetic coil arrangements for responding respectively to said electrical scanning waveform and to said supplementary electrical waveform.

3. An arrangement according to claim 1 wherein said circuit means, for generating said electrical scanning waveform, comprises a sawtooth waveform generator circuit.

4. An arrangement according to claim 3 wherein said further circuit means, for generating said supplementary electrical waveform, comprises a generator of substantially sinusoidal oscillations.

5. An arrangement according to claim 4 including a clock pulse generating circuit for synchronising the operations of said sawtooth waveform generator circuit and said generator of substantially sinusoidal oscillations.

6. An arrangement according to claim 5 including a divider circuit connected between said clock pulse generating circuit and said sawtooth waveform generator circuit.

7. An arrangement according to claim 5 including switch means for selectively opening and closing the path between said clock pulse generating circuit and said generator of substantially sinusoidal oscillations to convert the scanning of said beam from a dwelling movement to a smooth movement or vice-versa.

* * * * *